United States Patent [19]

Takahashi et al.

[11] Patent Number: 5,074,739

[45] Date of Patent: Dec. 24, 1991

[54] PAPER SHEET PROCESSING APPARATUS

[75] Inventors: Hitoshi Takahashi; Toshinori Adachi, both of Yokohama, Japan

[73] Assignee: Kabushiki Kaisha Toshiba, Kawasaki, Japan

[21] Appl. No.: 497,972

[22] Filed: Mar. 23, 1990

[30] Foreign Application Priority Data

Mar. 30, 1989 [JP] Japan ..... 1-81005

[51] Int. Cl.[5] ..... B65B 69/00

[52] U.S. Cl. ..... 414/412; 83/909

[58] Field of Search ..... 414/412; 83/153, 909; 209/426.4, 564.3

[56] References Cited

U.S. PATENT DOCUMENTS

| | | | |
|---|---|---|---|
| 4,404,723 | 9/1983 | Ohba et al. | 83/909 X |
| 4,414,730 | 11/1983 | Ohmura et al. | 83/909 X |
| 4,660,818 | 4/1987 | Conner et al. | 83/909 X |
| 4,696,615 | 9/1987 | Ettischer et al. | 414/412 X |
| 4,773,148 | 9/1988 | Ohya et al. | 83/909 X |
| 4,831,713 | 5/1989 | Hoden et al. | 83/909 X |
| 4,838,751 | 6/1989 | Hanaya et al. | 414/412 |

FOREIGN PATENT DOCUMENTS

| | | | |
|---|---|---|---|
| 62-135145 | 6/1987 | Japan . | |
| 294335 | 12/1988 | Japan | 414/412 |
| 199837 | 8/1989 | Japan | 414/412 |

*Primary Examiner*—David A. Bucci

*Attorney, Agent, or Firm*—Cushman, Darby & Cushman

[57] ABSTRACT

A paper sheet processing apparatus for removing a strap from a sheaf formed by bundling a number of paper sheets with the strap. The paper sheet processing apparatus includes a strap cutter for cutting the strap of the sheaf, a strap scraping unit for penetrating between the paper sheets and the strap after the strap has been cut by the strap cutter and scraping out the strap from the sheaf, and separating unit for completely separating the strap from the sheaf. This paper sheet processing apparatus can be provided for sheaves of paper sheets and can execute a guaranteed removal of the strap which has been cut.

18 Claims, 14 Drawing Sheets

PAPER SHEET PROCESSING APPARATUS

BACKGROUND OF THE INVENTION

1. Field of the Invention

The present invention relates to a paper sheet processing apparatus in which a wrapping strap wound around a sheaf of paper sheets is automatically removed to loosen the paper sheets.

2. Description of the Related Art

There is known in the prior art an apparatus which is designed to receive bundled bank notes, remove the wrapping strap from the bank notes, and prepare them for inspecting. This apparatus is used in the inspection and processing systems which execute inspections of bank notes.

As shown in FIGS. 13A to 13H, sheaf H is formed by bundling a number (for instance, 100) of bank notes C with a strap K. There are various ways of bundling bank notes C with strap K, as shown in FIGS. 13A to 13H. In these cases, strap K is not only simply round the outside of bank notes C, as in FIG. 13A, it also frequently penetrates between bank notes C, FIGS. 13B to 13H.

When strap K is removed from this sheaf H, in the conventional apparatus such as shown in Japanese Laid Open Patent (Kokai) 62-135145, strap K is cut first by cutter 1000. Then, strap K is removed by the catcher 1001 from the side of bank notes C while the catcher 1001 is gripping strap K.

However, in the case of the conventional apparatus described above, all of strap K will not be removed by the grip and transport operation of catcher 1001, since strap K was not only wrapped several times round the outside of bank notes C but also penetrated between the bank notes C. Thus, the remaining portions of strap K were transported to the inspection and processing stage for bank notes C, and there was the problem that this caused difficulties, such as jamming, in the inspection process.

SUMMARY OF THE INVENTION

The present invention has been contrived in view of the aforementioned circumstances, and is intended to provide a bank note processing apparatus which can provide guaranteed removal of straps from bank notes in the sheaf state.

According to one aspect of the present invention, there is provided a paper sheet processing apparatus for removing a strap from a sheaf formed by bundling a number of paper sheets with the strap, comprising means for cutting the strap on the sheaf; means for penetrating between the paper sheets and the strap after the strap has been cut by the cutting means, and scraping out the strap from the sheaf; and means for completely separating the strap from the sheaf.

DETAILED DESCRIPTION OF THE PREFERRED EMBODIMENT

Referring to the accompanying drawings, a detailed description will subsequently be given of the preferred embodiment of the present invention.

Figure 1:
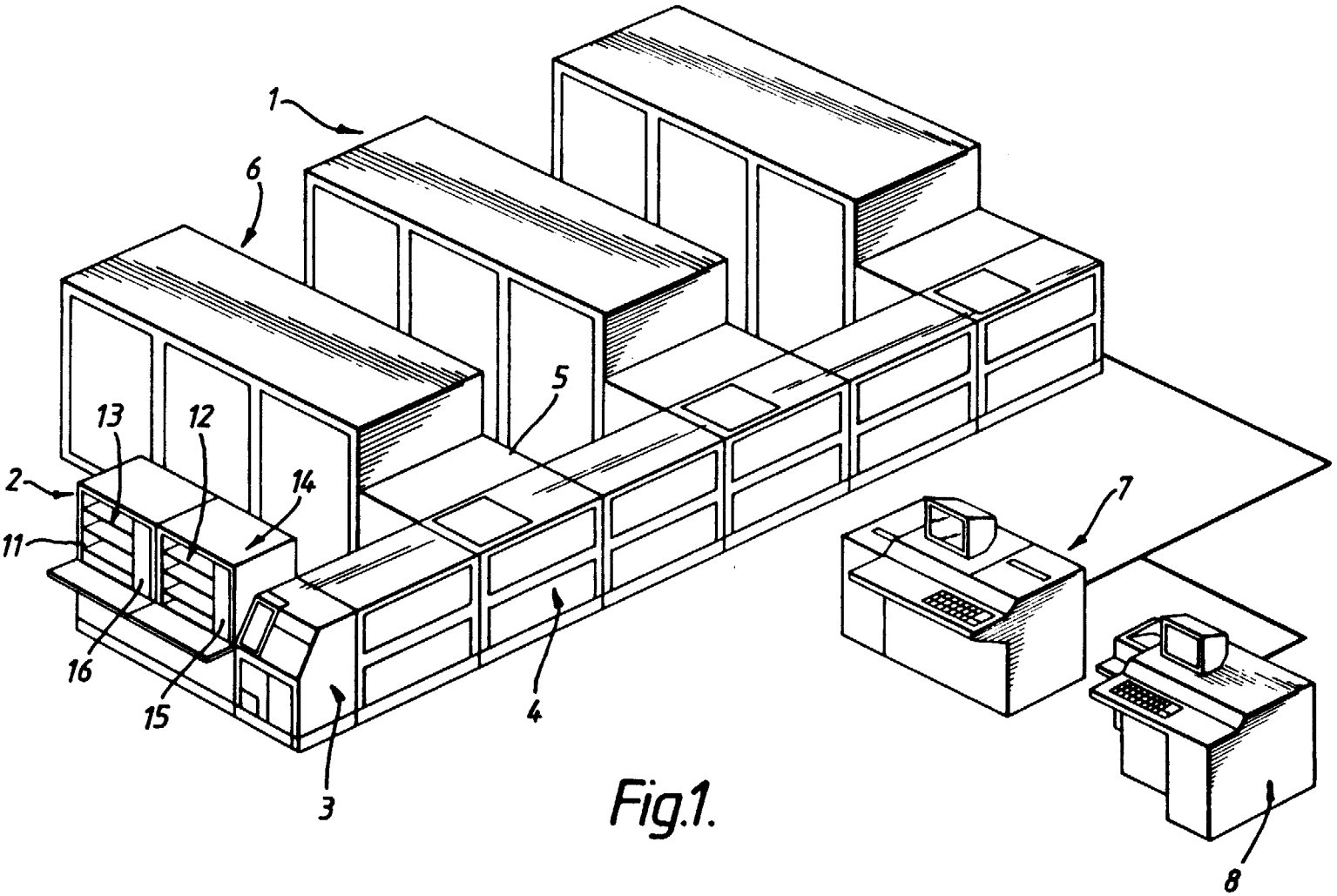
FIG. 1 is an external perspective view of a inspection and processing system including a paper sheet processing apparatus of the present invention.

FIG. 1 shows the external appearance of an entire inspection and processing system 1 which includes strap removal device 400 for sheaves of bank notes.

Inspection and processing system 1 comprises bundle processing unit 2 which executes the processes of storage, carrying-out and carrying-in of unchecked (hereafter, "unprocessed") and checked (hereafter, "processed") bundles of bank notes (hereafter, "bundles"); reject unit 3 which executes a reject operation for unprocessed bundles or processed bundles which have been carried-out or carried-in to bundle processing unit 2; bundle conveying unit 4 which executes the conveying of bundles between reject unit 3 and pre-processing unit 5 described below; pre-processing unit 5 which includes strap removal device 400 which receives unprocessed bundles and prepares them in the sheaf H form and, at the same time, removes straps K from sheaves H; and discriminating unit 6 which receives bank notes from preprocessing unit 5, executes a specified discrimination process and outputs sealed processed bundles which are the inspected bank notes-resealed by bands.

Furthermore, inspection and processing system 1 is provided with rejected note processing unit 7 which processes the unreusable bank notes dispensed from discriminating unit 6, and moreover, it is provided with centralized control unit 8 which executes overall control of the systems and totalization processing of processed bank notes.

Bundle processing unit 2 is provided with bundle stacking unit 14, composed of unprocessed bundle stacker 12 and processed bundle stacker 13 each having a number of shelves 11; carrying-out bundle elevator device 15 and carrying-in bundle elevator device 16 which perform the vertical transport of unprocessed bundles from bundle stacking unit 14 and the vertical transport of processed bundle to bundle stacking unit 14; and a transport device (not shown).

Figure 2:
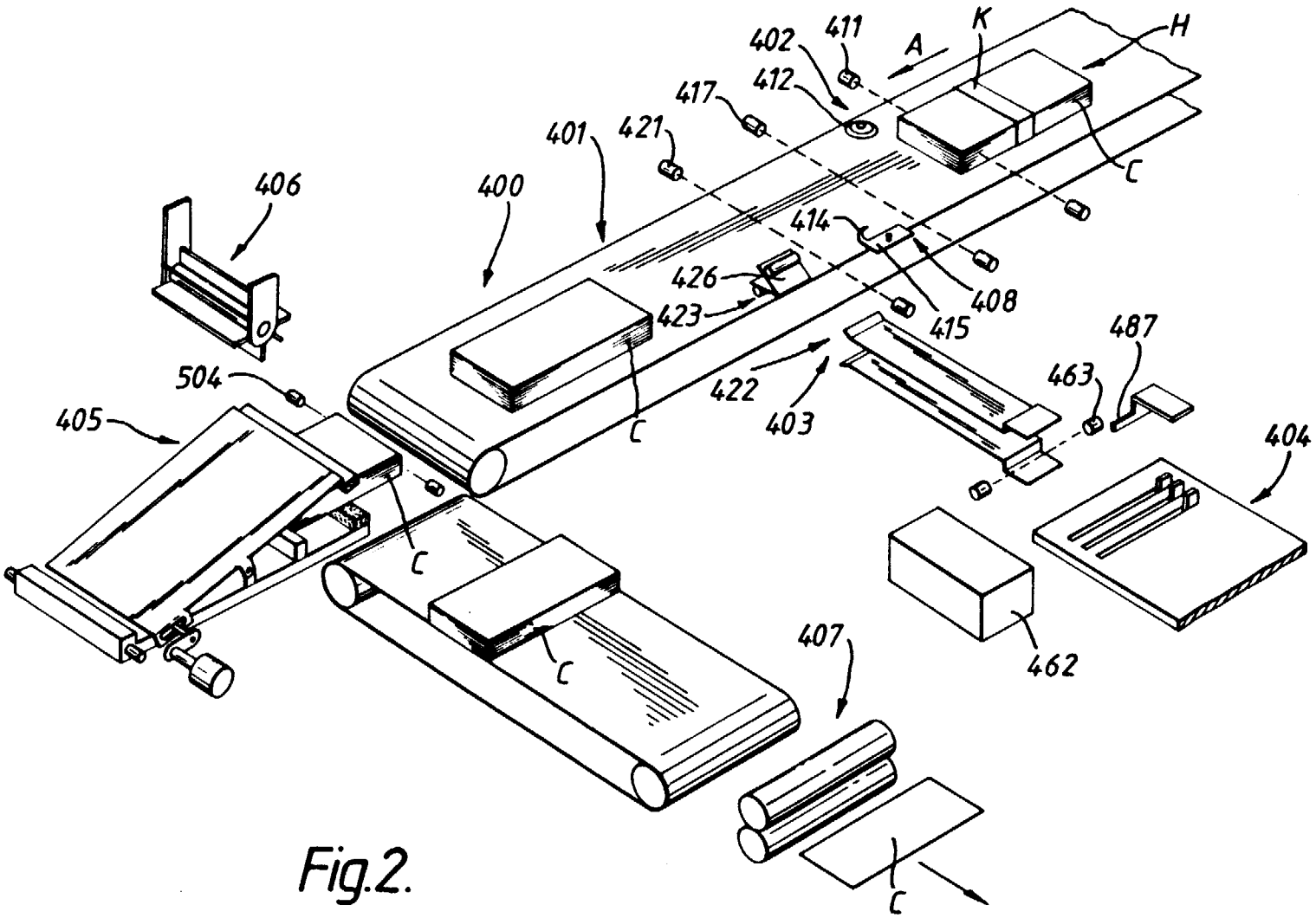
FIG. 2 is a schematic perspective view of the paper sheet processing apparatus of the present invention.

Strap removal device 400 for sheaves of bank notes in pre-processing unit 5 is constructed as shown in FIG. 2.

Strap removal device 400 for sheaves of bank notes is provided with the following: sheave conveying device 401; cutting device 402 which detects sheaf H transported by sheaf conveying device 401 and cuts strap K which forms sheaf H; strap scraping out unit 408; strap removal unit 403 which grips strap K which has been cut by cutting device 402 and removes it from one side of sheaf conveying device 401; strap storage processing unit 404 which presses in and stores strap K which has been removed by strap removal unit 403; grip and rotating unit 405 which grips and rotates the large number of bank notes C from which strap K has been removed; scraping away unit 406 which butts against bank notes C which are rotated by grip and rotating unit 405 and scrapes away the portions of strap K remaining around bank notes C and between the bank notes after the cutting process; and bank notes dealing unit 407 which transports bank notes C after completion of the scraping process by scraping away unit 406 and, at the same time, transports the bank notes one by one to discriminating unit 6.

As shown in FIG. 2, cutting device 402 is provided with first sheaf sensor 411, in which a light-emitting element and a light-receiving element are used, which detects sheaf H being conveyed in the direction shown by arrow A on sheaf conveying device 401; and strap cutter 412 which is positioned in the vicinity of first sheaf sensor 411 and which faces the conveying zone of sheaf H.

As shown in FIGS. 2, 3A, 3B and 3C, strap scraping out unit 408 is provided with scraping out member 415 supported by support shaft 413 so that it can be rotated and having scraping out claw 414, including a tip which penetrates between bank notes C and strap K of sheaf H; scraping out driving unit 416 which drives scraping out member 415; and second sheaf sensor 417, composed of a light-emitting element and a light-receiving element, which detects sheaf H on sheaf conveying device 401.

Figure 3A:
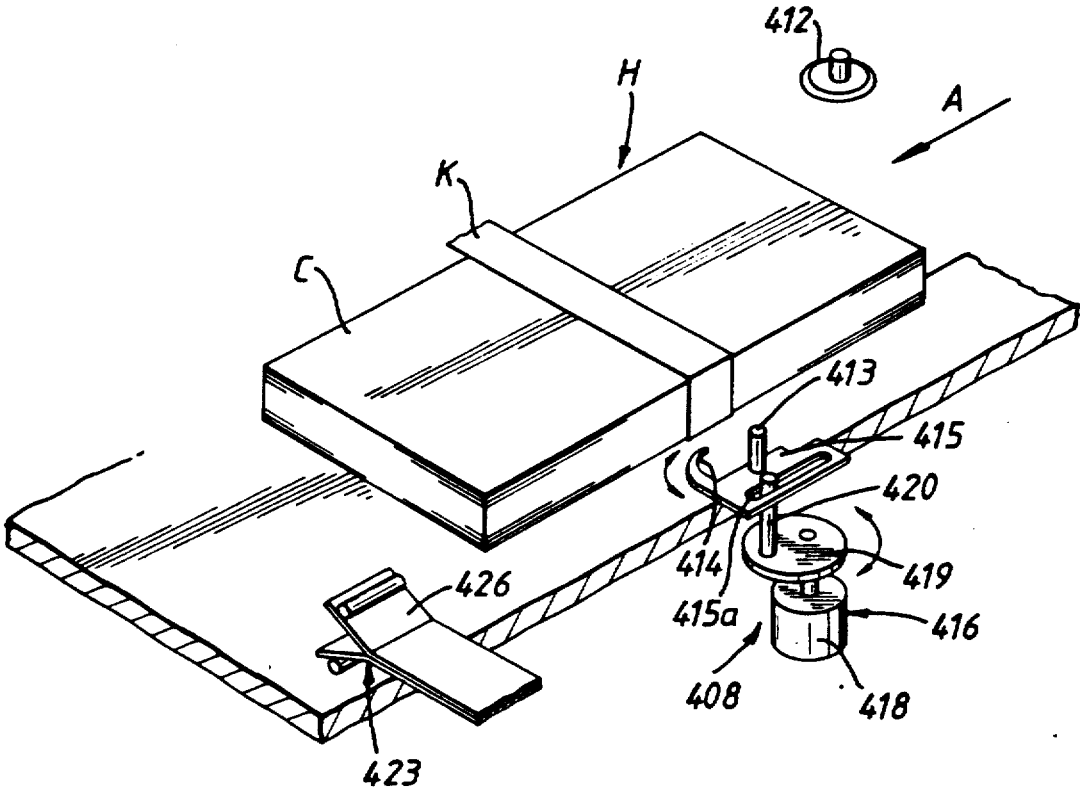
FIG. 3A is a perspective view showing a scraping out device of the paper sheet processing apparatus.

As shown in FIG. 3A, scraping out driving unit 416 is provided with scraping-out motor 418 which is positioned securely beneath scraping out member 415; eccentric idler 419 which is fixed to the spindle of scraping out motor 418; and pin 420 which projects from eccentric idler 419 at the eccentric position on eccentric idler 419. The design is that, by rotating scraping out motor 418 in a clockwise direction and a counterclockwise direction in the state in which pin 420 is engaged in slot 415*a* provided in scraping out member 415, scraping out claw 414 of scraping out member 415 is made to penetrate between strap K and bank notes C and scrape strap K.

Figure 4:
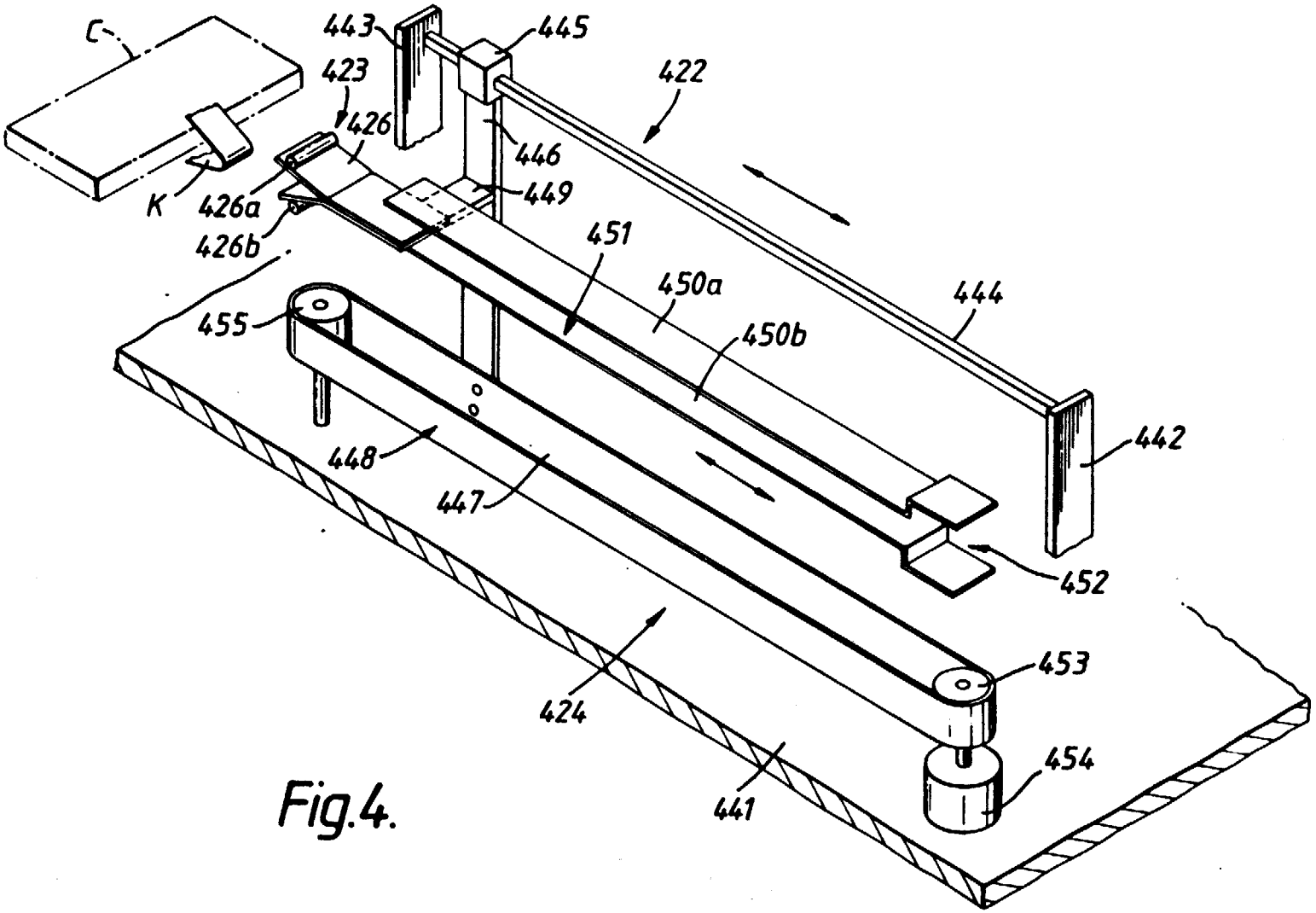
FIG. 4 is a perspective view showing the strap removal device of the paper sheet processing apparatus.
Figure 5:
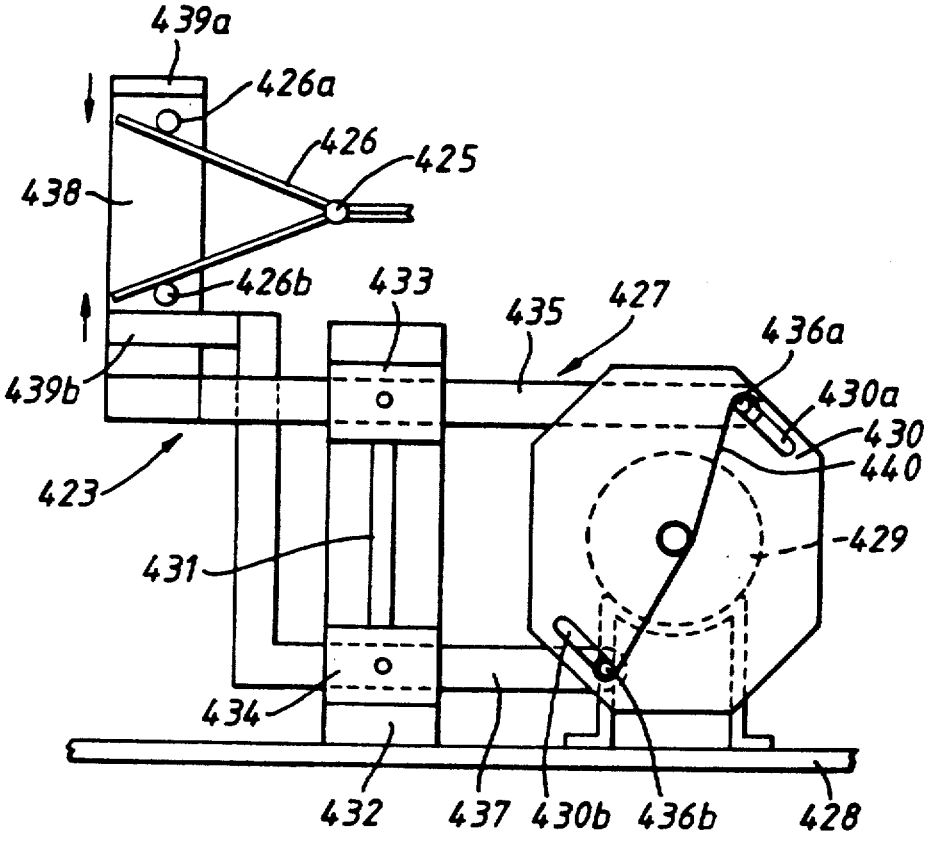
FIG. 5 is a side view showing a strap catcher and catcher driving unit of the paper sheet processing apparatus.

As shown in FIGS. 2, 4 and 5, strap removal unit 403 is provided with third sheaf sensor 421, composed of a light-emitting element and a light-receiving element, which detects sheaf H on sheaf conveying device 401; and strap grip and conveyor unit 422.

As shown in FIG. 4, strap grip and conveyor unit 422 is provided with strap grip portion 423 which grips strap K; and strap transport unit 424 which executes the conveying of strap grip portion 423.

As shown in FIGS. 4 and 5, strap grip portion 423 is provided with strap catcher 426, fitted with rollers 426*a* and 426*b*, which closes and opens in the directions of the arrows with rotating support spindle 425 as a fulcrum; and catcher drive unit 427 which drives the opening and closing of strap catcher 426.

Catcher drive unit 427 is provided with base board 428 positioned beneath strap catcher 426; rotary solenoid 429 mounted on base board 428 and which executes rotary operation; rotating plate 430, having symmetrical slots 430*a* and 430*b*, mounted on the rotating spindle of rotary solenoid 429; guide 432, fitted with guide rail 431, which is secured on base board 428; a pair of sliding blocks 433 and 434 fitted to slide vertically, guided by guide rail 431; and upper lever 435, which passes through sliding block 433, with one end facing below strap catcher 426 and the other end facing slot 430*a* on one side of rotating plate 430.

Catcher drive unit 427 is further provided with first engaging pin 436*a* which projects from upper lever 435 and engages in slot 430*a*; lower lever 437, which passes through sliding block 434, having a first end which is bent upwards at an angle of 90 degrees from lower lever 437 and extending to a slightly higher position than upper lever 435, and having a second end facing slot 430*b* on the other side of rotating plate 430; second engaging pin 436*b* which projects from lower lever 437 and engages in slot 430*b*; presser member 438, provided with first butting piece 439*a* which projects from on end of upper lever 435 along the side face of strap catcher 426 and butts against the upper side of strap catcher 426, and second butting piece 439*b* which projects from the edge of lower lever 437 in a position parallel to upper lever 435 and butts against the lower side of strap catcher 426; and energizing member 440, wound round the rotating spindle of rotary solenoid 429, which applies a resisting force to the rotational force due to rotary solenoid 429 by pressing against both first engaging pin 436*a* with one end and second engaging pin 436*b* with the other end.

As shown in FIG. 4, strap transport unit 424 is provided with base board 441 secured at the side of sheaf conveying device 401; a pair of fixed supporting pieces 442 and 443 which are secured in fixed positions with a specified spacing by base board 441; guide rail 444 which is supported horizontally by both fixed supporting pieces 442 and 443; slide member 445 mounted on guide rail 444 so that it can slide thereon; slide plate 446 of which the upper end is mounted on slide member 445 and which projects vertically downwards; strap conveyor mechanism unit 448 having belt 447 which is secured to the lower end of slide plate 446; linking member 449, which is linked to the rear end of strap catcher 426, positioned about the center of slide-plate 446; and a pair of catch guide plates 450*a* and 450*b* which are positioned along the transfer zone of strap catcher 426 above and below that transfer zone and parallel to guide rail 444.

The spacing of these two catch guide plates 450*a* and 450*b* is such that, when strap catcher 426 penetrates between the two catch guide plates 450*a* and 450*b*, narrow portion 451, which makes strap catch close, and wide portion 452, which makes strap catch open, are formed continuously but at different levels.

Strap conveyor mechanism unit 448 is provided with strap transport motor 454, fitted with pulley 453, which is secured on base board 441 below the wide portion 452 of catch guide plate 450*b*; driven pulley 455, which is positioned below the end of catch guide plate 450*b* at the penetrating end of strap catcher 426; and belt 447 which is wound around pulleys 453 and 455 and whose outer surface is secured to slide plate 446.

Figure 7:
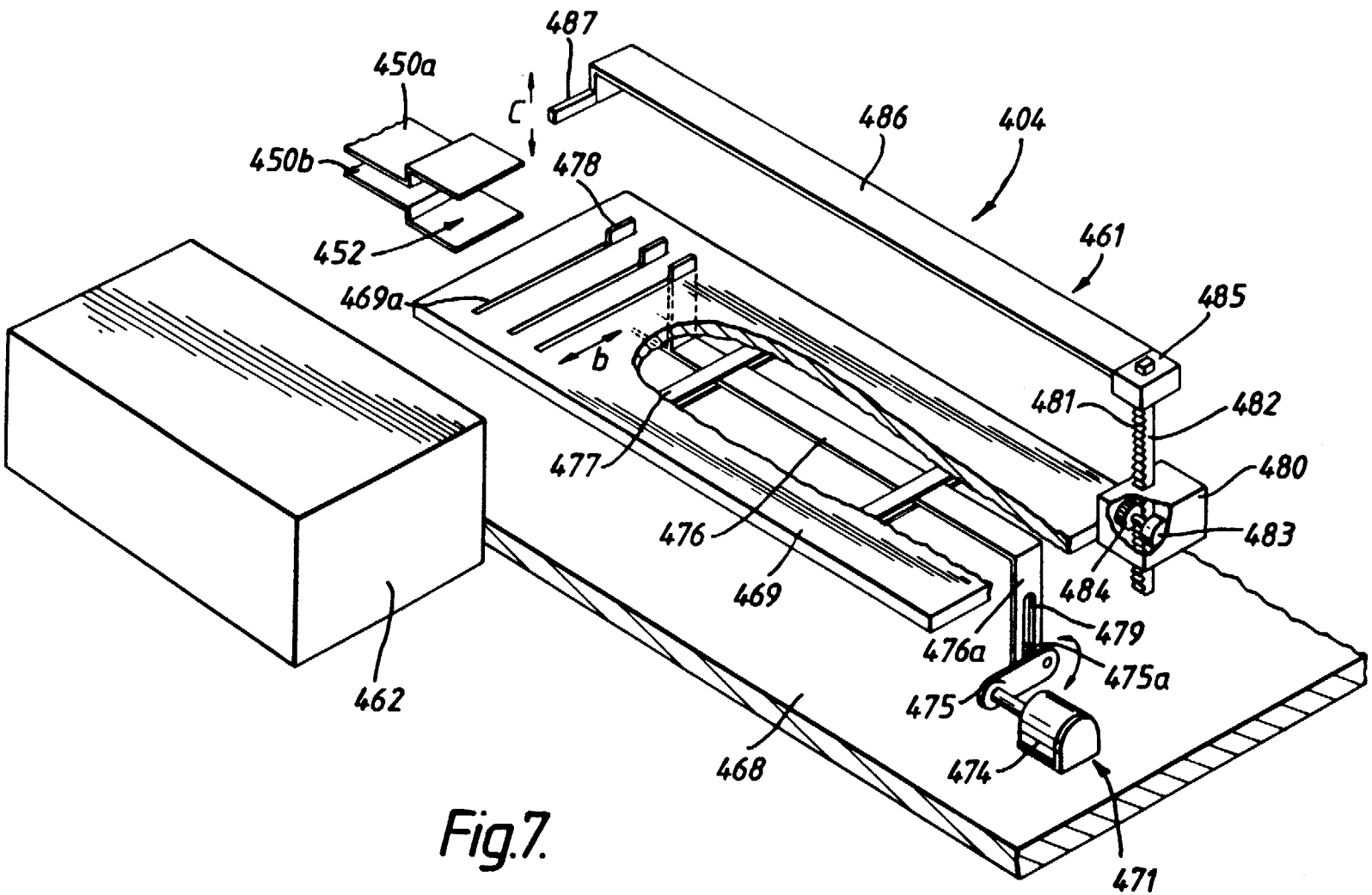
FIG. 7 is a perspective view showing a strap storage processing unit.

Strap storage processing unit 404 comprises strap presser unit 461 and strap storage box 462, as shown in FIG. 7.

Strap placement plate 469 is arranged parallel to supporting plate 468. Strap storage mechanism unit 471 transfers strap K placed on strap placement plate 469 to strap storage box 462.

Strap storage mechanism unit 471 comprises storage transfer motor 474 secured on supporting plate 468; rotating arm 475 driven in the directions of the arrow shown in FIG. 7 by storage transfer motor 474; slide lever 476 supported so that it can slide in the directions of arrow b by guide pieces 477 which are mounted on the under side of strap placement plate 469; vertical piece 476*a* provided in a vertical position at one end of slide lever 476 and in which slot 479 is provided which engages with projecting pin 475*a* projecting from rotating arm 475; and three strap pressing claws 478 which project upward from the other end of slide lever 476 and are thrust respectively, through three slots 469*a* provided in strap placement plate 469 in the b directions to project further upwards.

Strap presser unit 461 is provided with vertical transfer box 480 secured to the end face of strap placement plate 469; vertical guide rail 482, fitted with rack 481, and supported so that it can move in the vertical direction by vertical transfer box 480; vertical transfer motor 483 secured inside vertical transfer box 480; pinion 484 which engages with rack 481 provided on vertical guide rail 482 and is secured to the power spindle of vertical transfer motor 483; fixed member 485 secured to the upper end of vertical guide rail 482; presser supporting plate 486 supported at one end by fixed member 485 and of which the other end extends above slots 469*a;* and square rod-shaped strap presser piece 487 provided at the end of presser supporting plate 486.

The operation performed by this design is that, by rotating pinion 484 using vertical transfer motor 483, one causes vertical guide rail 482 to descend, which in turn causes strap presser piece 487 to descend in the c direction (the vertical direction) thus pressing strap K onto strap placement plate 469.

Grip and rotating unit 405 and scraping away unit 406 are described with reference to FIG. 8.

Grip and rotating unit 405 is positioned at the end of sheaf conveying device 401. It grips and rotates bank notes C from which strap K has been removed.

Figure 8:
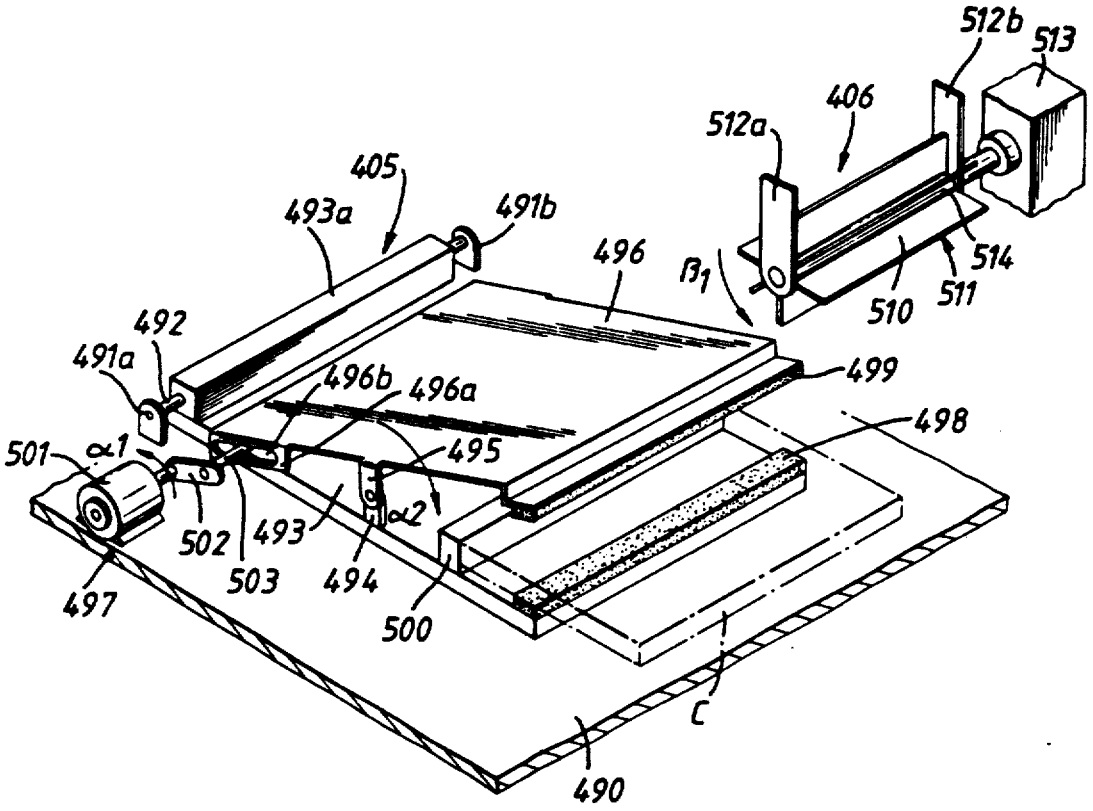
FIG. 8 is a perspective view of a grip and rotating unit and a scraping away unit.

That is, grip and rotating unit 405 is provided with securing plate 490 positioned beneath the end of strap conveying device 401; a pair of supporting frames 491*a* and 491*b* set at a specified spacing on securing plate 490; supporting shaft 492 which spans between supporting frames 491*a* and 491*b;* lower grip member 493 whose rear end is supported by supporting shaft 492 so that it can rotate, and whose flat plate-shaped portion is placed on securing plate 490; projecting piece 494 set about mid-way along the edge of lower grip member 493; upper grip member 496 which has upper supporting piece 495, mounted on projecting piece 494 so that it can rotate, end which is formed in approximately the same shape as lower grip member 493; and driving unit 497 which rotates upper grip member 496 towards lower grip member 493 until both grip members are in direct physical contact, thereby performing a closing operation, and after this closing operation is completed, driving unit 497 also rotates both lower and upper grip member 493 and 496 simultaneously in the direction of arrow $\alpha_1$, shown in FIG. 8.

In FIG. 8, reference numerals 498 and 499 denote grip pieces with large friction coefficients bonded to the tips of grip members 493 and 496, respectively. Grip piece 498 faces upward, while grip piece 499 faces downward. Thus, when the closing operation occurs, grip pieces 498 and 499 face each other. Also, reference numeral 500 denotes a paper stopper which is provided mid-way between the top of lower grip member 493 and projecting piece 494 along the same direction as supporting shaft 492.

Driving unit 497 is provided with motor 501 positioned on securing plate 490; arm 502 of which one end is mounted on the drive spindle of motor 501; and engaging pin 503 which projects from the other end of arm 502 towards upper grip member 496. The design is that engaging pin 503 engages in slot 496*b* of bent piece 496*a* which is mounted at the edge of upper grip member 496.

As shown in FIG. 2, grip and rotating unit 405 is also provided with bank notes sensor 504, composed of a light-emitting element and a light-receiving element, which detects the presence of bank notes C between the two grip members 493 and 496.

Scraping away unit 406, which is positioned in the rotating zone of bank notes C which are gripped and rotated by grip and rotating unit 405 as shown in FIG. 8, is provided with rotor 511 on which, for instance, six plates 510 made of rubber are radially arranged around axis 514; a pair of supporting plates 512*a* and 512*b* which support rotor 511 so that it can rotate; and drive source 513 25 which drives rotor 511 in the direction of arrow $\beta_1$.

Figure 10A:
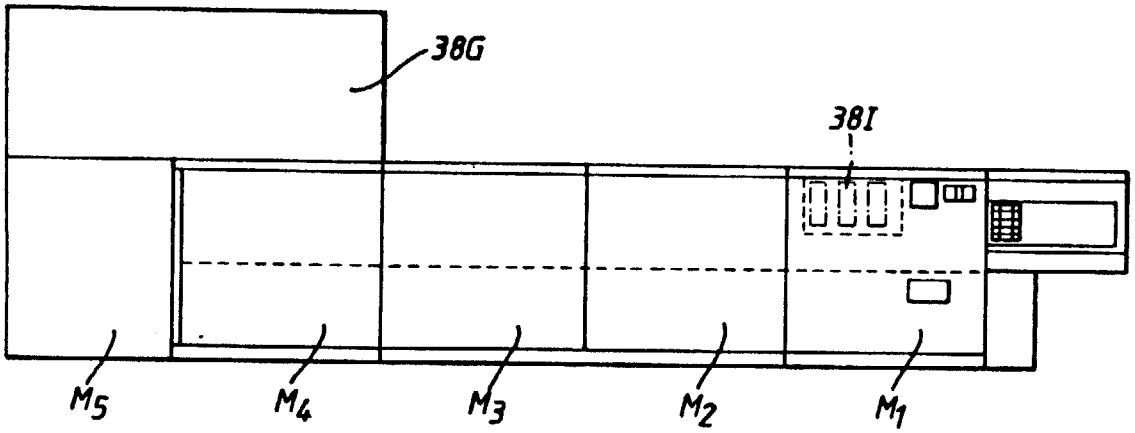
FIGS. 10A to 10C are respectively a plan view, a cross-section view and a side view of a discriminating unit.

An outline of discrimination unit 6 is described with reference to FIGS. 10A, 10B and 10C.

Figure 10B:
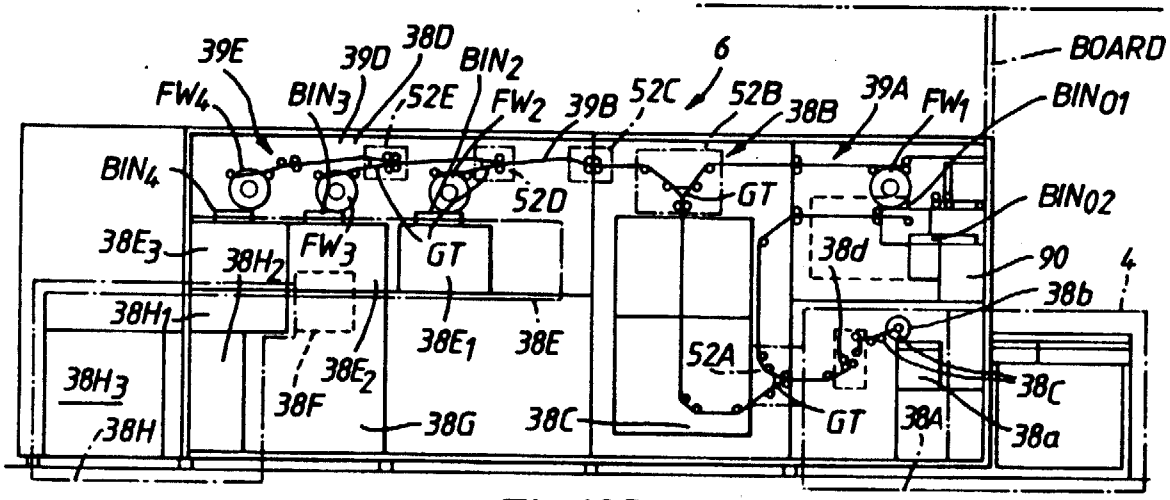
Figure 10C:
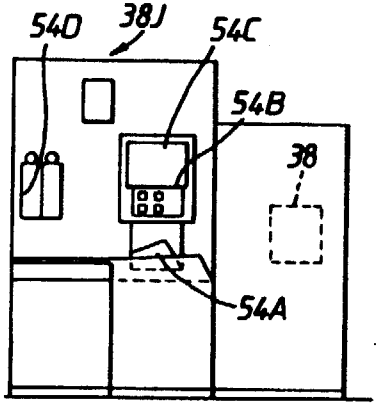

As shown in FIG. 10B, discriminating unit 6 is provided with extractor unit 38A, conveyor and sorter unit 38B, discriminating unit 38C, sorter and stacker unit 38D, sheaf sealing unit 38E, bundle sealing unit 38F, bundle packaging unit 38G, invalidation unit 38H, control unit 38I and operation display unit 38J.

Operation display unit 38J is one example of an operating unit, and extractor unit 38A, conveyor and sorter unit 38B, discriminating unit 38C, sorter and stacker unit 38D, sheaf sealing unit 38E, bundle sealing unit 38F, bundle packaging unit 38G and invalidation unit 38H are examples of mechanical units. To prevent noise from the mechanical units from reaching the operating unit, a wall BOARD is provided from floor to ceiling of the space surrounding operation display 38J in which the system is installed so that the operating unit and the mechanical units are roughly divided by this wall BOARD.

Sorter and stacker unit 38D is divided into reject note sorter/stacker section 39A, different note sorter/-stacker section 39B, correct note sorter/stacker section 39D and unfit note sorter/stacker section 39E, and conveyor and sorter unit 38B is also provided with five divisions (52A to 52E) in the transport route based on the above divisions. Gates GT are provided at each conveyor and sorter unit 38B. Moreover, known recovery wheels $FW_1$ to $FW_4$ are respectively provided in each sorter/stacker section 39A to 39E, and the design is that notes which are transported-in can be extracted one by one and stacked in stackers BIN. Among these stacker sections, two note stackers $BIN_{01}$ (counterfeit note stacker) and $BIN_{02}$ (unmachinable note stacker) are provided above and below in reject note sorter/-stacker section 39A. Stackers $BIN_2$ to BIN are arranged with one in each of the other sorter/stacker sections. Also, sheaf sealing unit 38E is divided and positioned as $38E_1$, $38E_2$ and $38E_3$ respectively beneath each stacker $BIN_2$ to $BIN_4$. Bundle sealing unit 38F is provided below sheaf sealing unit 38E, which is provided below correct note sorter/stacker section 39D, and a window for receipt and delivery of notes is provided in the back of bundle packaging unit 38G. Extractor unit 38A comprises stacking section 38*a* in which a number of notes which have been extracted one by one are stacked; take out roller 38*b* which extracts the notes one by one; conveyor roller group 38C which conveys these extracted notes; and checking section 38*d*, provided in the conveyor route, which checks the characteristics of the notes (uncheckable state such as multiple extraction, skew and short pitch.)

Checking section 38*d* and discriminating unit 38C are examples of the checking systems which check notes according to specified items, and the design is that the results of the checks by these two units are stored in memory unit 220 in control unit 38I. Extractor unit 38A is designed not to extract a note from the next sheaf until the processing of the previous sheaf is completed. Also, as shown in FIG. 10C, operation display unit 38J comprises intake port unit 54A for sheaves which have been supplied, and operator unit 54B which includes a ten-key, CRT 54C for monitoring and cassette take out port 54D which are all provided above it. The sections in which each of the above units are housed are each separate modules. As shown in FIG. 10A, the design is that supply and feeding module $M_1$, discriminating module $M_2$, first and second stacking modules $M_3$ and $M_4$, scrapping module $M_5$ and bundle packaging unit 38G are respectively positioned so that they can be installed and removed, and thus they can be increased or decreased as desired according to usage and function. Also, as shown in FIG. 10B, reject note sorter/stacker section 39A and extractor unit 38A, which are divided above and below, are housed in feeding module $M_1$ and control unit 38I is housed behind them. Moreover, discriminating unit 38C and first and second conveyor/sorter sections 52A and 52B are housed in module $M_2$. Different note sorter/stacker section 39B, sheaf sealing unit 38E and third and fourth conveyor/sorter sections 52C and 52D are housed in module $M_3$. Correct note sorter/stacker section 39D with its sheaf sealing unit $38E_2$, unfit note sorter/stacker section 39E with its sheaf sealing unit $38E_3$, fifth conveyor/sorter section 52E and shredders $38H_1$, and $38H_2$ as the first and second invalidation units are housed in module $M_4$. Disposal box $38H_3$ is housed in module $M_5$.

Also, reject note cassette 90, which functions as the reject note storage unit is provided in the vicinity of the two note stackers $BIN_{01}$ and $BIN_{02}$.

Figure 11:
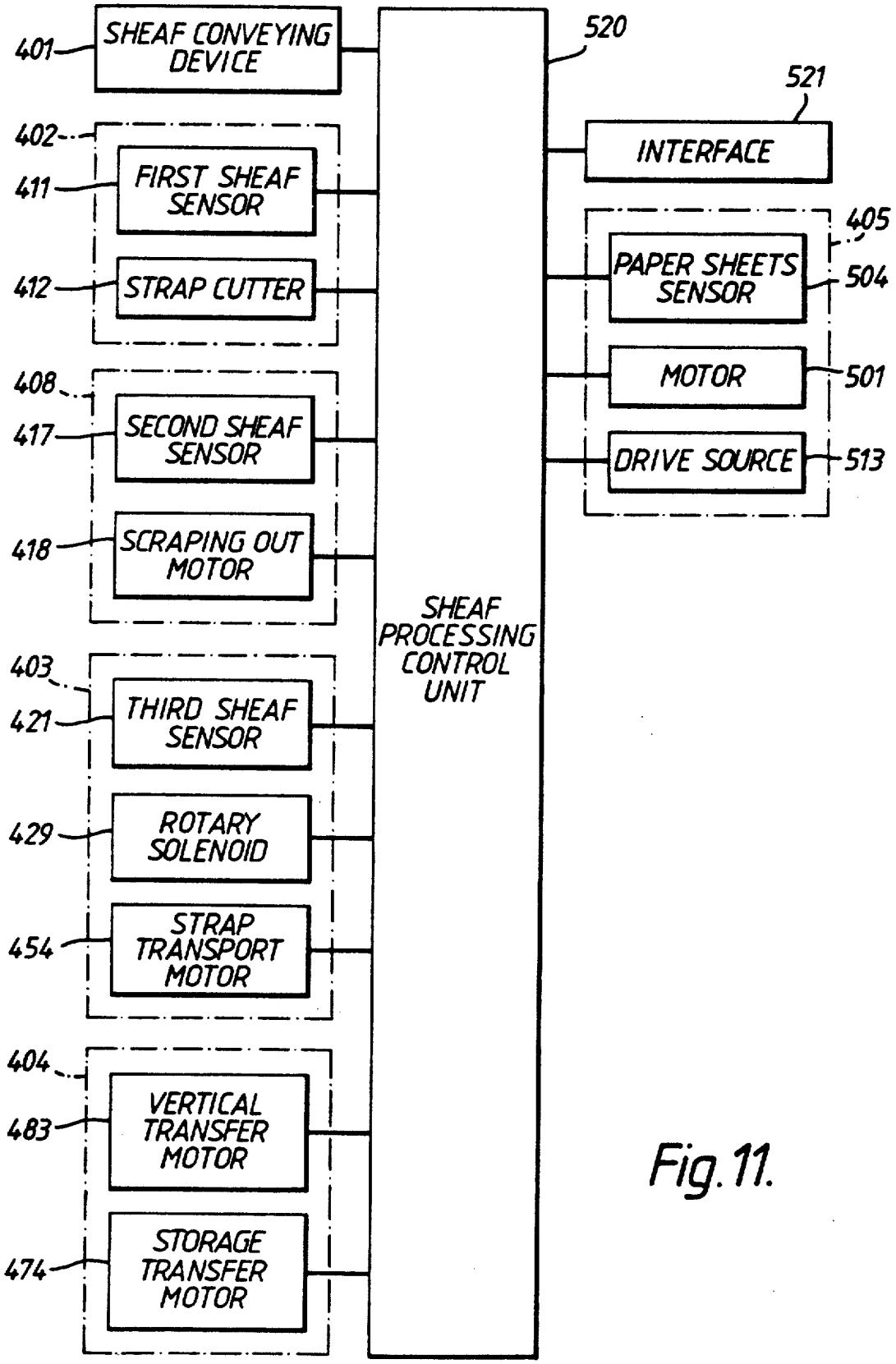
FIG. 11 is a block diagram showing a control system of the paper sheet processing apparatus.

The control system for strap removal device 400 is described with reference to FIG. 11.

Strap removal device 400 is provided with sheaf processing control unit 520 which receives control signals from centralized control unit 8 via interface 521 and controls each element of strap removal device 400 based on these control signals. Sheaf conveying device 401, first sheaf sensor 411 of cutting device 402, strap cutter 412, second sheaf sensor 417 of strap scraping out unit 408 and scraping-out motor 418 are each connected to the sheaf processing control unit 520.

Third sheaf sensor 421 of strap removal unit 403, rotary solenoid 429, strap transport motor 454, and vertical transfer motor 483 and storage transfer motor 474 of strap storage processing unit 404 are each connected to sheaf processing control unit 520.

Moreover, bank note sensor 504 of grip and rotating unit 405 and motor 501 are each connected to sheaf processing control unit 520. Furthermore, the design is that bank note dealing unit 407 is controlled by sheaf processing control unit 520.

Figure 12:
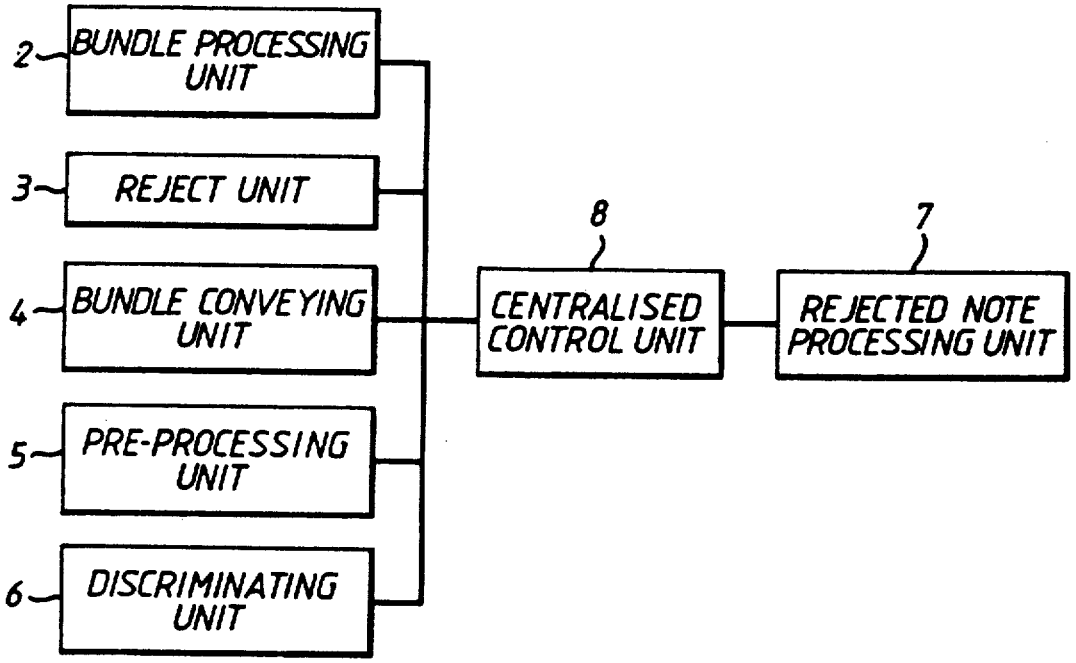
FIG. 12 is a block diagram of the entire inspection and processing system.
Figure 13A:
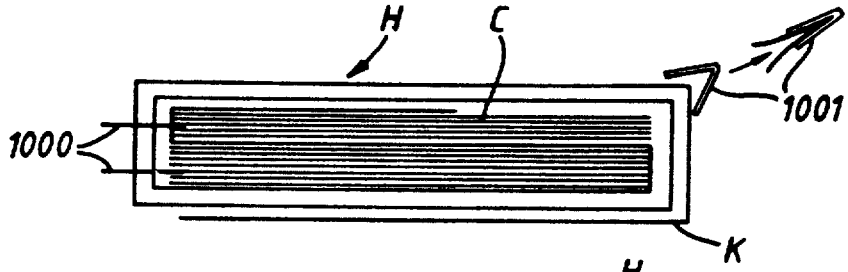
Fig.13A. (PRIOR ART)
FIGS. 13A to 13H are schematic side views showing respective bundling states of sheaves.
Figure 13B:
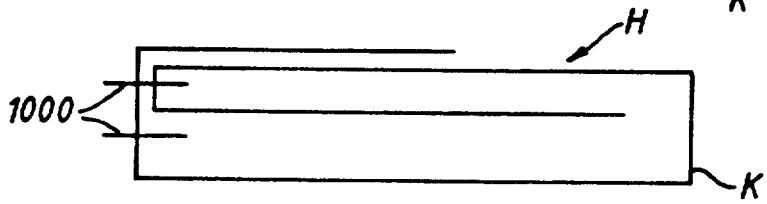
Fig.13B. (PRIOR ART)
Figure 13C:
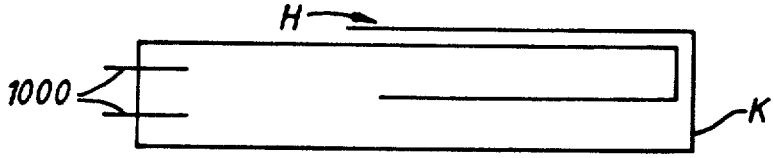
Fig.13C. (PRIOR ART)
Figure 13D:
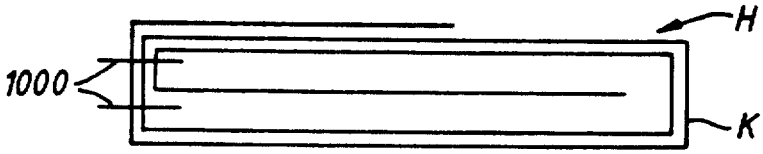
Fig.13D. (PRIOR ART)
Figure 13E:
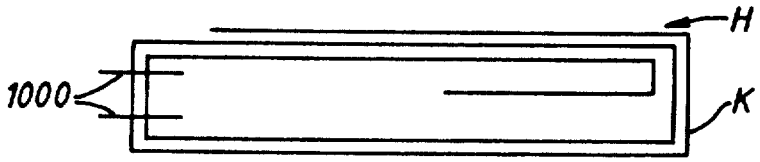
Fig.13E. (PRIOR ART)
Figure 13F:
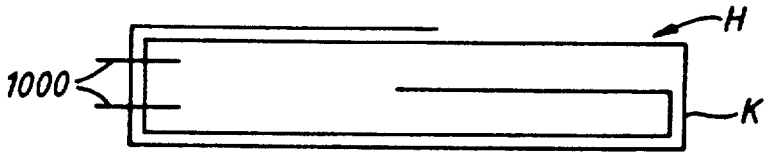
Fig.13F. (PRIOR ART)
Figure 13G:
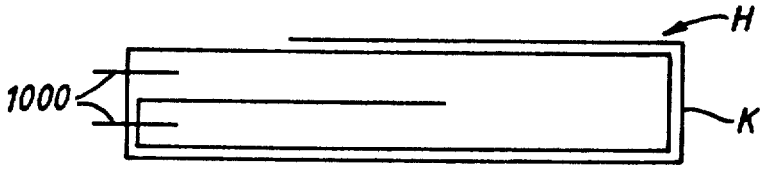
Fig.13G. (PRIOR ART)
Figure 13H:
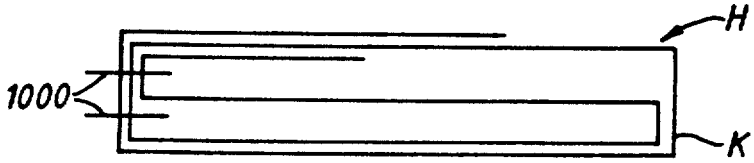
Fig.13H. (PRIOR ART)

As shown in FIG. 12, centralized control unit 8 is designed to control each of bundle processing unit 2, reject unit 3, bundle conveying unit 4, pre-processing unit 5 discriminating unit 6 and rejected note processing unit 7.

The following is a description of the operation of strap removal device 400.

When sheaf H is conveyed in the direction of arrow A shown in FIG. 2 by sheaf conveying device 401, sheaf H is first detected by first sheaf sensor 411, and by this means strap cutter 412 is rotated under the control of sheaf processing control unit 520, and strap K is cut.

Figure 3B:
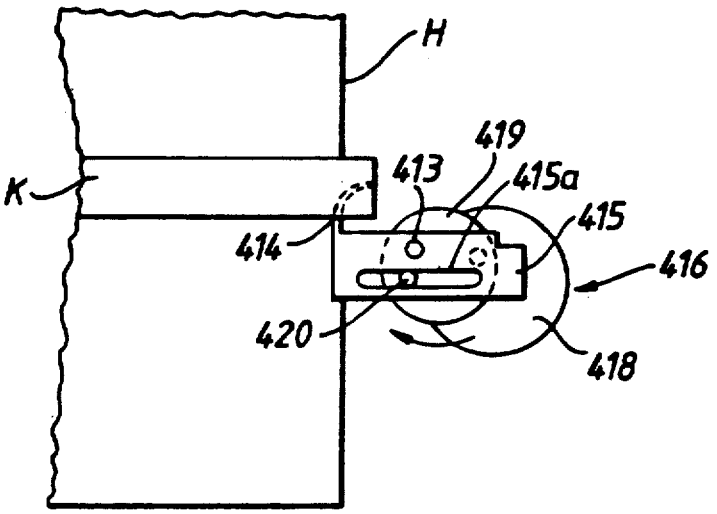
FIGS. 3B and 3C are plan views showing the operation of the scraping out device.
Figure 3C:
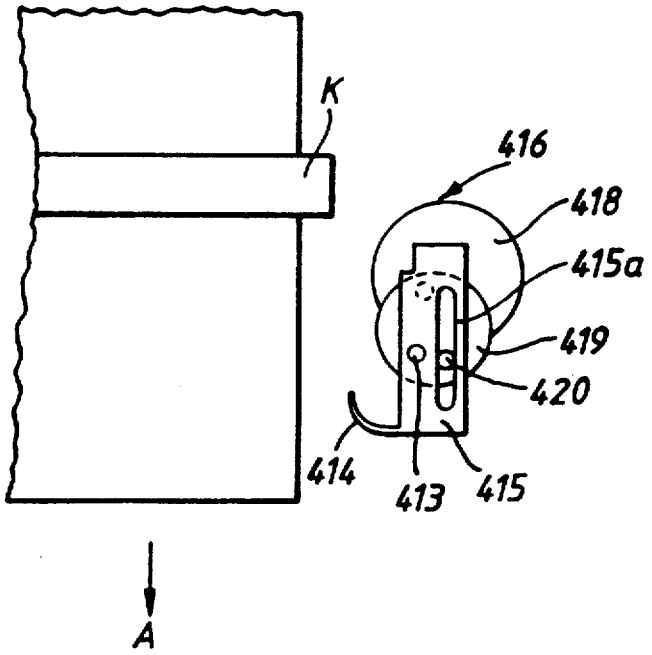

Sheaf H with strap K cut is further conveyed in the direction of the arrow, and is detected by second sheaf sensor 417. By this means, as shown in FIG. 3B, scraping-out motor 418 is driven under the control of sheaf processing control unit 520 and rotates the eccentric idler 419 and pin 420. Together with the rotation of pin 420, scraping out member 415 also rotates about support shaft 413 as a fulcrum, and scraping out claw 414 penetrates between the bank notes C and strap K, and scrapes out strap K. After this, strap K, which has been scraped out by the reverse rotation of scraping-out motor 418, as shown in FIG. 3C, still remains around and inside bank notes C.

In this state, bank notes C and strap K are further conveyed in the direction of the arrow by sheaf conveying device 401.

Then, third sheaf sensor 421 detects bank notes C and strap K. In response to a signal from third sheaf sensor 421, strap removal unit 403 executes the removal operation of strap K which has been cut and scraped out.

Figure 6A:
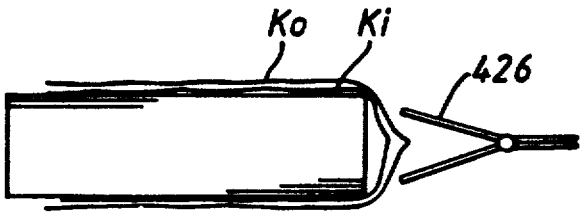
FIGS. 6A to 6D are schematic side views showing the grip and transport operation of the strap by the strap catcher.

During this removal operation of strap K, strap catcher 426 is transported in the open state by strap transport motor 454 and belt 447 of strap transport unit 424, and approaches the side of bank notes C. Then, rotation of rotary solenoid 429 causes linear motion of lower lever 437 in the upward direction, while simultaneously causing linear motion of upper lever 435 in the downward direction. This motion further causes movement of second butting piece 439*b* in the upward direction, and movement of first butting piece 439*a* downward. Second butting piece 439*b* thus applies a vertical force upon roller 426*b*, while first butting piece 439*a* simultaneously applies a vertical force upon roller 426*a*, which force is opposite in direction of the force on roller 426*b*. In this manner, the compressing action of first and second butting pieces 439*a* and 439*b* is executed in the direction of the arrow shown in FIG. 5, causing the strip catcher to close. By this means, strap catcher 426 grips strap Ko, which is an outer strap, as shown in FIG. 6A.

Figure 6B:
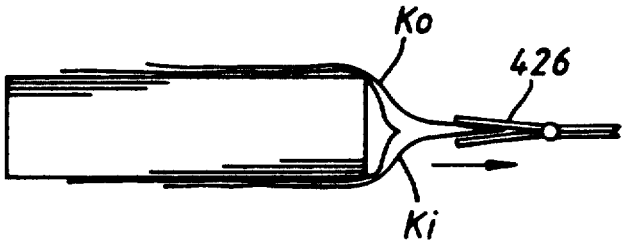

Next, with rotary solenoid 429 still receiving electrical power, that is to say with strap catcher 426 still gripping strap Ko, strap transport motor 454 temporarily reverses its direction. By this means, strap catcher 426 temporarily pulls outside strap Ko away from bank notes C. This condition is shown in FIG. 6B.

Figure 6C:
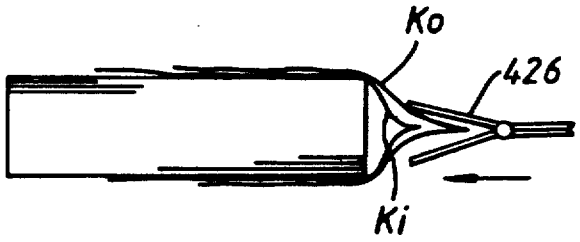

Next, strap transport motor 454 once more rotates forward, thereby causing strap catcher 426 to move back towards bank notes C. At the same time, rotary solenoid 429 is temporarily removed from its power source. Energizing member 440 then exerts a force upon rotating plate 430 so that the rotating plate rotates in the opposite direction. Rotation of the plate causes linear motion simultaneously in lower lever 437 and upper lever 435. As both upper and lower levers move, first butting piece 439*a* also moves vertically upward, thereby removing the force which had been applied to roller 426*a*. Likewise, second butting piece 439*b* moves vertically downward, and the force which had been applied by it to roller 426*b* is also removed. Thus, strap catcher 426 is opened as shown in FIG. 6C.

Figure 6D:
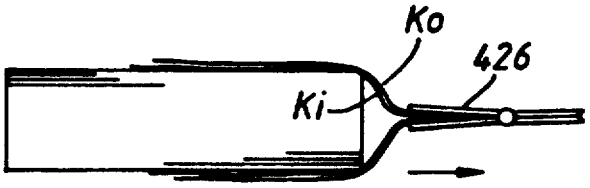

Next, strap catcher 426 is again closed in the same manner as described above. This time, strap catcher 426 grips not only outside strap Ko, but also inside strap Ki, as shown in FIG. 6D. By this kind of double gripping operation of strap catcher 426, the strap catcher can grip strap K even if strap K is, for instance, wound twice round the outside of bank notes C.

Once this double gripping operation is completed, strap transport motor 454 is driven forwards while strap catcher 426 is still gripping strap K, and strap catcher 426 is transported by strap conveyor mechanism 448 along narrow section 451 of catch guide plates 450*a* and 450*b*. Moving drive belt 447 causes slide plate 446 to move away from conveying device 401. Since strap catcher 426 is fixedly attached to slide plate 446 by way of linking member 449, strap catcher 426 also is displaced horizontally away from conveying device 401, as shown in FIG. 4. Moreover, since rollers 426*a* and 426*b* of strap catcher 426 are restricted in their vertical movement by narrow section 451, strap catcher 426 maintains its grip on strap K even though rotary solenoid 429 is removed from its power source.

Finally, when strap catcher 426 reaches wide section 452, the restriction on vertical motion of rollers 426*a* and 426*b* is removed. Since strap catcher 426 no longer grips at this point, strap K is released from strap catcher 426 and gravity causes strap K to drop on strap placement plate 469.

At this time, strap catcher 426 is driven by strap transport motor 454 in the opposite direction back through wide portion 452 and narrow portion 451, until strap catcher 426 clears the catch guide plates 450*a* and 450*b*, and returns to its initial position.

Next, in the strap presser unit shown in FIG. 7, vertical transfer motor 483 starts and drives presser support plate 486 and strap presser piece 487 vertically downwards. By this means, strap presser piece 487 presses strap K onto strap placement plate 469. After this, vertical transfer motor 483 is reversed and returns strap presser piece 487 to its original position.

The process continues when storage transfer motor 474 starts under the control of sheaf processing control unit 520 and rotates rotating arm 475 and projecting pin 475*a*. By this means, slide lever 476 and strap pressing claws 478 also slide along slots 469*a*. As the sliding occurs, the claws impart a force upon strap K, thereby transferring strap K, which has been pressed onto strap placement plate 469, over the edge of strap placement plate 469 and into strap storage box 462. Transferred strap K is then stored in strep storage box 462.

At the same time, bank notes C from which strap K has been removed by strap removal unit 403 continue to be conveyed by sheaf conveying device 401.

Figure 9A:
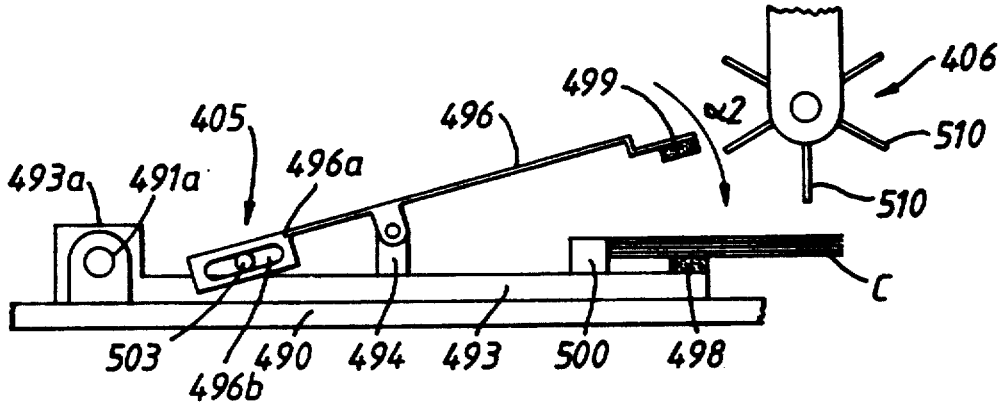
FIGS. 9A to 9C are schematic side views showing the operation of the grip and rotating unit and the scraping away unit.
Figure 9B:
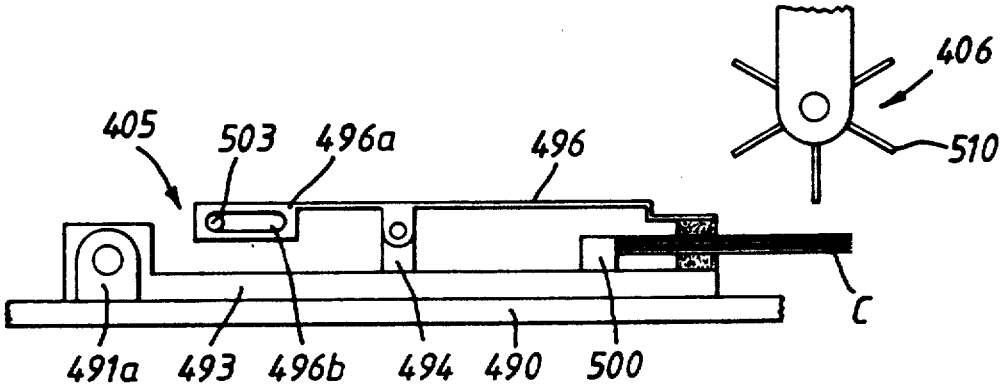

These bank notes C are next detected by bank note sensor 504, which causes motor 501, for gripping and rotating, to rotate in the direction of arrow $\alpha_1$ in FIG. 8 under the control of sheaf processing control unit 520. Then, as shown in FIG. 9A, arm 502 and engaging pin 503 also rotate in the $\alpha_1$ direction. Thus, together with bent piece 496*a*, which engages with engaging pin 503, upper grip member 496 rotates in direction $\alpha_2$, which is the reverse direction to $\alpha_1$, with projecting piece 494 as its fulcrum. As a result, bank notes C are gripped between grip pieces 498 and 499 which are provided on the two grip members 493 and 496. This condition is shown in FIG. 9B.

Figure 9C:
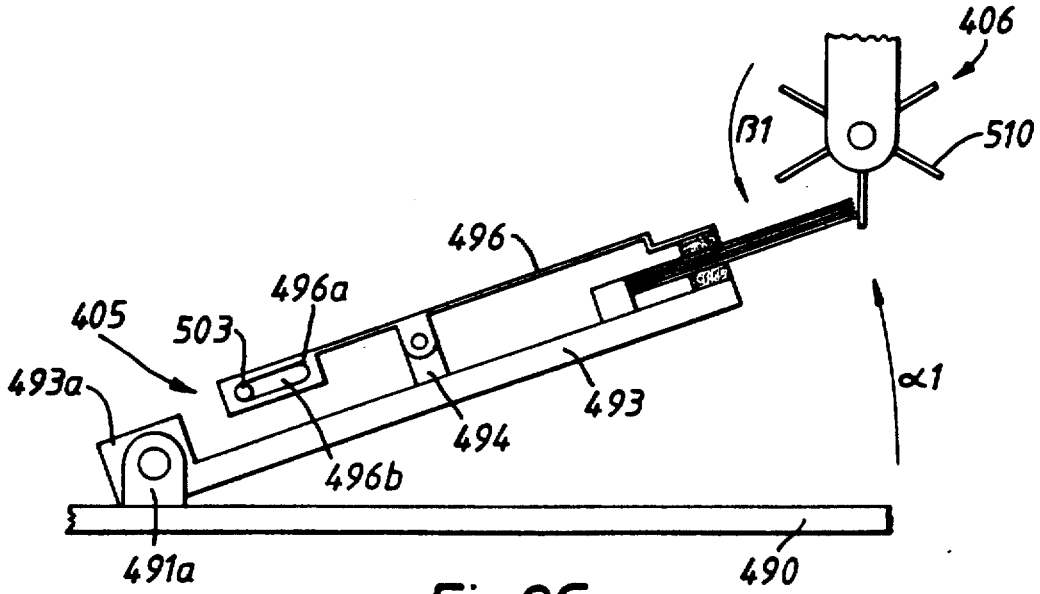

When motor 501 rotates further in the $\alpha_1$ direction, since engaging pin 503 butts against the end of slot 496*b*, upper grip member 496 can no longer rotate in the $\alpha_2$ direction, and instead it rotates in the $\alpha_1$ direction, together with lower grip member 493, as shown in FIG. 9C.

Finally, bank notes C, which are gripped by the two grip members 493 and 496, butt against plates 510 of scraping away unit 406. By the rotation of these plates 510 in the $\beta_1$ direction, a number of bank notes C are brushed, in this manner, any piece of strap which remains between bank notes C is scraped away.

After this, motor 501 runs in the reverse mode, returning the bank notes C to their original position in the grip and rotating unit, and releasing the bank notes C from grip pieces 498 and 499 by the reverse operation to that described above.

Once this has occurred, the bank notes C are conveyed to bank notes dealing unit 407 by a pusher (not shown), which applies a horizontal force to the side of sheaf H opposite from bank note dealing unit 407, thereby causing sheaf H to move onto a new conveying unit, as shown in FIG. 2. Here, they are divided into single bank notes and are conveyed into discriminating unit 6.

According to the present invention as described above, since the cutting of the strap which seals the bank notes, and the scraping out and removal of the strap after cutting is executed by using the above composition, a strap removal apparatus can be provided for sheaves of bank notes which can execute a guaranteed removal process of the strap which has been cut. In this embodiment, the bank note processing has been described. However, the present invention may also be widely applied to paper sheet processing apparatus wherein paper sheets similar to bank notes are processed.

Various other modifications could be made in the present invention without departing from the scope or spirit of the following claims.

What is claimed is:

1. A paper sheet processing apparatus for removing a strap from a sheaf formed by bundling a number of paper sheets with the strap, comprising:

means for cutting the strap;

means for penetrating between the paper sheets and the strap after the strap has been cut by the cutting means and for scraping out the strap from the sheaf; and means for separating the strap from the sheaf after the strap has been scraped from the sheaf, the separating means comprising:

means for gripping the strap from a gripping position adjacent to the sheaf, means for moving the gripping means away from the gripping position, and control means for causing the gripping means to continue gripping the strap while the gripping mean sis being moved, and for causing the gripping means to release the strap upon reaching a predetermined position.

2. The apparatus of claim 1, wherein the moving means includes means for returning the gripping means from the predetermined position to the gripping position for gripping any remaining strap from the sheaf.

3. The apparatus of claim 1, wherein the gripping means includes:

a strap catcher which is normally open, the strap catcher having a pair of rollers; and a presser member having a pair of members to butt against the pair of rollers for closing the strap catcher.

4. The apparatus of claim 3, wherein the control means includes a pair of catch guide plates arranged in parallel to form a narrow portion in which the strap catcher closes by butting the pair of rollers thereto while the strap catcher is moved by the moving means and a wide portion in which the strap catcher opens by releasing the pair of rollers therefrom.

5. A paper sheet processing apparatus for removing a strap from a sheaf formed by bundling a number of paper sheets with the strap, comprising:

means for cutting the strap;

means for penetrating between the paper sheets and the strap after the strap has been cut by the cutting means and for scraping out the strap from the sheaf, the penetrating means comprising:

a scraping out member having a claw supported by a shaft, and means for rotating the scraping out member for penetrating the claw into the paper sheets of the sheaf and drawing the strap from the sheaf; and means for separating the strap from the sheaf after the strap has been scraped from the sheaf.

6. The apparatus of claim 5, wherein the scraping out member has a slot, and the rotating means also includes:

an eccentric idler having a pin projecting therefrom at the eccentric position thereon, the pin engaging in the slot; and a motor for rotating the eccentric idler in the reverse direction.

7. A paper sheet processing apparatus for removing a strap from a sheaf formed by bundling a number of paper sheets with the strap, comprising:

means for cutting the strap;

means for penetrating between the paper sheets and the strap after the strap has been cut by the cutting means and for scraping out the strap from the sheaf;

means for separating the strap from the sheaf after the strap has been scraped from the sheaf; and means for scraping away the strap which remains between the paper sheets of the sheaf.

8. The apparatus of claim 7, wherein the scraping means includes:

means for gripping the sheaf in which the strap has been removed by the separating means; and means for brushing the sheaf to remove any portions of the strap which remain between the paper sheets of the sheaf.

9. The apparatus of claim 8, wherein the brushing means includes:

a plurality of plates made of rubber radially arranged around an axis; and a drive source for rotating the plates about the axis.

10. A paper sheet processing apparatus for removing a strap from a sheaf formed by bundling a number of paper sheets with the strap, comprising:

means for conveying the sheaf bundled with the strap;

first sheaf detecting means for detecting the sheaf conveyed by the conveying means and outputting a first detecting signal;

means, responsive to the first detecting signal, for cutting the strap of the sheaf;

second sheaf detecting means for detecting the sheaf in which the strap has been cut and outputting a second detecting signal;

means, responsive to the second detecting signal, for penetrating between the paper sheets and the strap after the strap has been cut by the cutting means and for scraping out the strap from the sheaf;

means for separating the strap from the sheaf, the separating means comprising:

means for gripping the strap from a gripping position adjacent to the sheaf, means for moving the gripping means away from the gripping position, and control means for causing the gripping means to continue gripping the strap while the gripping means is being moved, and for causing the gripping means to release the strap upon reaching a predetermined position.

11. The apparatus of claim 10, wherein the moving means includes means for returning the gripping means from the predetermined position to the gripping position for gripping any remaining strap from the sheaf.

12. The apparatus of claim 11, wherein the gripping means includes:

a strap catcher which is normally open, the strap catcher having a pair of rollers; and a presser member having a pair of members to butt against the pair of rollers for closing the strap catcher.

13. The apparatus of claim 12, wherein the control means includes a pair of catch guide plates arranged in parallel to form a narrow portion in which the strap catcher closes by butting the pair of rollers thereto while the strap catcher is moved by the moving means and a wide portion in which the strap catcher opens by releasing the pair of rollers therefrom.

14. A paper sheet processing apparatus for removing a strap from a sheaf formed by bundling a number of paper sheets with the strap, comprising:

means for conveying the sheaf bundled with the strap;

first sheaf detecting means for detecting the sheaf conveyed by the conveying means and outputting a first detecting signal;

means, responsive to the first detecting signal, for cutting the strap of the sheaf;

second sheaf detecting means for detecting the sheaf in which the strap has been cut and outputting a second detecting signal;

means, responsive to the second detecting signal for penetrating between the paper sheets and the strap after the strap has been cut by the cutting means and for scraping out the strap from the sheaf, the penetrating means comprising:

a scraping out member having a claw supported by a shaft, and means for rotating the scraping out member for penetrating the claw into the paper sheets of the sheaf and drawing the strap from the sheaf; and means for separating the strap from the sheaf.

15. The apparatus of claim 14, wherein the scraping out member has a slot, and the rotating means also includes:

an eccentric idler having a pin projected therefrom at the eccentric position thereon, the pin engaging in the slot; and a motor for rotating the eccentric idler in the reverse direction.

16. A paper sheet processing apparatus for removing a strap from a sheaf formed by bundling a number of paper sheets with the strap, comprising:

means for conveying the sheaf bundled with the strap;

first sheaf detecting means for detecting the sheaf conveyed by the conveying means and outputting a first detecting signal;

means, responsive to the first detecting signal, for cutting the strap of the sheaf;

second sheaf detecting means for detecting the sheaf in which the strap has been cut and outputting a second detecting signal;

means, responsive to the second detecting signal, for penetrating between the paper sheets and the strap after the strap has been cut by the cutting means and for scraping out the strap from the sheaf;

means for separating the strap from the sheaf; and means for scraping away the strap which remains between the paper sheets of the sheaf.

17. The apparatus of claim 16, wherein the scraping means includes:

means for gripping the sheaf in which the strap has been removed by the separating means; and means for brushing the sheaf to remove any portions of the strap which remain between the paper sheets of the sheaf.

18. The apparatus of claim 17, wherein the brushing means includes:

a plurality of plates made of rubber radially arranged around an axis; and a drive source for rotating the plates about the axis.

* * * * *